US005289746A

United States Patent [19]

Finn

[11] Patent Number: 5,289,746

[45] Date of Patent: Mar. 1, 1994

[54] PARALLEL JAW TOGGLE WRENCH

[76] Inventor: Donald J. Finn, Rte. 1, Box 1200, Jackson, S.C. 29831

[21] Appl. No.: 5,663

[22] Filed: Jan. 19, 1993

Related U.S. Application Data

[63] Continuation-in-part of Ser. No. 687,474, Apr. 18, 1991, abandoned.

[51] Int. Cl.[5] ..... B25B 7/12

[52] U.S. Cl. ..... 81/356; 81/126; 81/363; 81/373; 81/379

[58] Field of Search ..... 81/347, 352-356, 81/362-363, 373, 379, 389, 398, 126

[56] References Cited

U.S. PATENT DOCUMENTS 2,556,725 6/1951 Hurlbut ..... 81/347 X
3,340,754 9/1967 Burchett ..... 81/356
3,608,405 9/1971 Schmidt ..... 81/356
4,274,312 6/1981 Finn ..... 81/356

*Primary Examiner*—D. S. Meislin
*Attorney, Agent, or Firm*—John A. Beehner

[57] ABSTRACT

A toggle wrench having a first jaw fixed to a handle. A sliding jaw is slidable toward and away from the fixed jaw. The jaws have parallel pressure surfaces disposed at an angle of 30 degrees with respect to the elongation of the handle. A link is pivoted to the forward end of the lever and has a forward end pivotally attached to the sliding jaw. A carrier is positionable along the handle by a manually controllable threaded adjustment assembly mounted on the rearward end of the handle. The lever is pivotally attached to the carrier rearwardly of the forward link. A movement of the rearward end of the link toward the fixed jaw side of the handle, which causes forward movement of the link for toggle-pressing the sliding jaw toward the fixed jaw. The carrier holds the lever and link in alignment with the handle.

10 Claims, 7 Drawing Sheets

PARALLEL JAW TOGGLE WRENCH

CROSS REFERENCE TO RELATED APPLICATION

This is a refile/substitution of U.S. patent application Ser. No. 323,407, filed on Mar. 14, 1989, and entitled: 30° JAW TOGGLE WRENCH and continuation-in-part application Ser. No. 687,474 entitled PARALLEL JAW TOGGLE WRENCH filed Apr. 18, 1991, both now abandoned.

BACKGROUND OF THE INVENTION

This invention relates generally to toggle wrenches that are operated by pressing a hand lever toward the handle and more particularly to such a toggle wrench having parallel jaws disposed at an angle of generally thirty degrees relative to the handle thereof.

In this field, wrenches mass produced have had jaws that approach a nut or bolt while being at an angle to each other. This is damaging to the nuts and bolts of good machinery.

The main object of this invention is to provide such a wrench with jaw surfaces which move in parallelism toward a nut for engaging the flat sides of the nut over broad areas.

Parallel jaw adjustable wrenches of the past have operated by the manipulation of worm gears. Such wrenches have a looseness and tend to slip off of a nut while great wrenching pressure is being applied. The suddenly released pressure causes an operator's knuckles to fly through the air, often being bodily cut on adjacent machinery and so they are nick-named "knuckle-busters".

The advantages of parallel jaws combined with the high gripping of a toggle are provided by the wrench hereof.

An earlier model, described in U.S. patent application titled PARALLEL JAW TOGGLE WRENCH WITH HOUSING, Ser. No. 07/232,591 and filed Aug. 15, 1988, the inventor being Donald J. Finn, shows a wrench having the advantages hereof with the exception that an angle of parallel jaw surfaces to handle length of substantially 30 degrees was not attainable therewith.

A hexagonal nut has tow surfaces at each corner that lie in planes 120 degrees apart and it is for that reason that the 30 degree handle angle is more effective.

Many nuts are in such tight spots that a 60 degree wrenching stroke is not possible. It is then that an approximately 30 degree angled-handle is most desirable.

This angle of approximately 30° permits the wrench hereof to be used in a very tight spot in the manner of most end wrenches. This advantage was not possible with the wrench of my own earlier application because a line between the my own earlier application because a line between the hand lever pivot and the sliding jaw would have been too near to a 90 degree angle.

This problem has been solved by experiment and with concepts in the wrench hereof (a) by providing a link between the hand lever and the sliding jaw, and (b) by providing for the pivot connection between the hand lever and the link to move upwardly, not downwardly, as the hand lever is squeezed toward the desirable 30 degrees even in a workable parallel jaw toggle wrench.

The prior art has a wrench in U.S. Pat. No. 4,274,312 issued Jun. 23, 1981 to Kenneth F. Finn and titled: PARALLEL JAW TOGGLE WRENCH. It has never been marketed. It lacked the strength needed to prevent bending of parts.

The wrench hereof is distinguished by being very rigid, very strong, and without any bending, or "give" or, "springing". This is because it's special open-topped housing of U-shape forms what can be termed "THE IRON TRIANGLE" as explained herein.

SUMMARY OF THE INVENTION

The parallel jaw toggle wrench of the present invention has a first jaw fixed to a handle and a second sliding jaw slidable toward and away from the fixed jaw. The first and second jaws have parallel pressure surfaces disposed at an angle of thirty degrees with respect to the elongation of the handle. A link is pivotally mounted to the forward end of the lever and has a forward end pivotally attached to the sliding jaw. A carrier is positionable along the handle by a manually controllable adjustment assembly mounted on the rearward end of the handle. The lever is pivotally attached to the carrier, rearwardly of the link. A movement of the rearward end of the link toward the fixed jaw side of the handle, causes forward movement of the link for toggle-pressing the sliding jaw toward the fixed jaw. The carrier holds the lever and link in alignment with the handle. Alternatively, the sliding jaw may be attached to the lever by means of a link connected to the sliding jaw and lever by means of a socket extending over center with respect to the jaw end lever so as to pivotally retain the link between the jaw and lever.

DESCRIPTION OF THE PREFERRED EMBODIMENT

Figure 2:
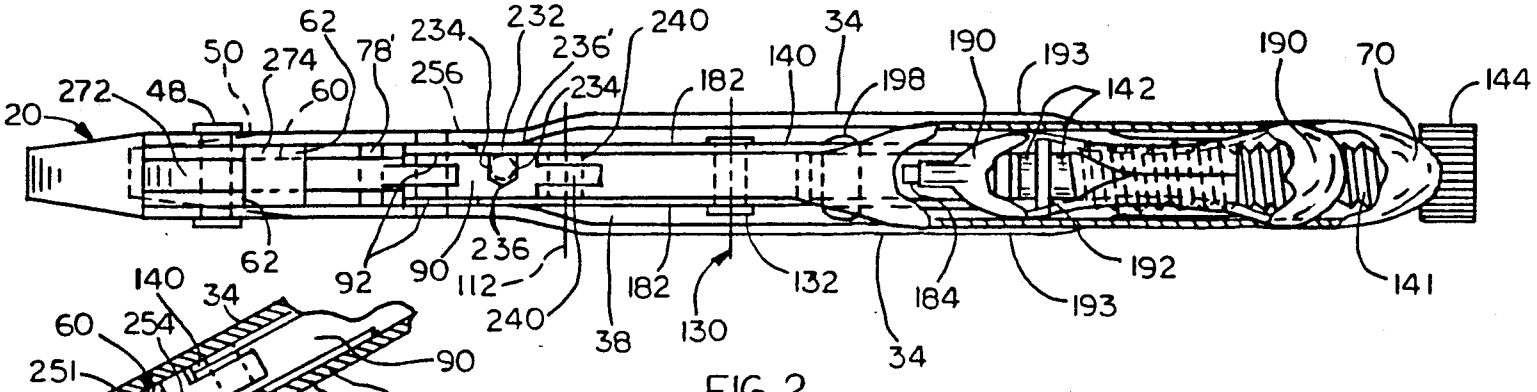
FIG. 2 is a top view with a portion of the handle and of a release broken away.

The wrench 10 hereof has a first jaw which is a fixed jaw 20. An elongated handle 30 extends rearwardly from the fixed jaw 20.

The handle 30, is one piece of steel and has right and left spaced sidewalls 34 connected together by a bottom wall 38.

The fixed jaw 20 has a forwardly extending first pressure surface 42 and a forward terminal end 44 and is attached to the handle 30 by suitable means such as a rivet 48, and also held by right and left tracks 62 welded to insides of the right and left handle sidewalls 34.

A sliding jaw 50 has a forwardly extending pressure surface 52. A track system 60 has right and left elongated tracks 62 welded to the inside of the right and left parallel vertical sidewalls 34 respectively and extending transversely of the jaw compression surfaces 42 and 52.

An elongated rearwardly extending had lever 70 has a forwarded portion 72 between the handle sidewalls 34 and a rearward portion 74 protruding from the handle 30 at its upper side.

The sliding jaw 50 has a rearward track follower track follower portion 78' cooperatively correlated with the tracks 62 by having notches 78 receiving the tracks respectively and thereby slidable secured to the tracks 62 for sliding of the sliding jaw 50 toward and away from the fixed jaw 30 while the sliding jaw compression surface 52 is always maintained transverse to the elongation of the main handle 30 and opposite and parallel to the fixed jaw surface 42.

A link 90 has a forward end pivotally attached by a horizontal pivot pin 92 to the track follower portion 78 of the sliding jaw 50 in a manner for the pivoting of the link about a forward axis 100 disposed transversely to the elongation of the handle 30.

The hand lever 70 is pivotally secured to the rearward end of the link 90 for rotation about an intermediate axis 112. The hand lever 70 is elongated and is generally in parallelism with the handle 30 and has a forward portion movably disposed between the sidewalls 34 of the handle 30.

The lever 70 has its rearward portion 74 protruding from the upper side of the handle 30 on the same side of the handle 30 that the fixed jaw 20 is disposed on.

A carrier 140, elongated in parallelism with handle 30, is disposed between its sidewalls 34.

A pivot pin 132 pivotally attaches the lever 70 to the carrier 140 for the pivoting of the lever 70 about a rearward axis 130 rearwardly of the intermediate axis 112.

The axes 100, 112 and 130 are parallel and normal to the elongation of the handle 30.

A threaded assembly 141 is mounted on the rearward end of the handle 30 and has a manually movable adjustment portion defined by a bolt 142 having a manually rotatable control 144. The threaded assembly 140 and specifically the bolt 142 thereof is operatively correlated with respect to the carrier 140. External threads of the bolt 142 engage internal threads of a hole 148 through the rearward end of the handle 30.

The forward end of the bolt, 142 engages the rearward end of the carrier 140. So movement of the adjustment bolt 142 forward and rearward will cause the carrier 140 to move forwardly and rearwardly.

The sliding jaw 50 with link 90 and the lever 70 attached to inside of carrier 140 together define an interconnected assembly 160. A tension spring 164 serves as is connected between the rearward track follower portion 78 of the sliding jaw 50 and the inner side of the bottom of the handle 30 and urges the sliding jaw 50 away from fixed jaw 20. The spring 164 is connected between the rearward track follower portion 78 of the sliding jaw 50 and the inner side of the bottom of handle 30.

The spring 164 serves not only to open the jaws but also to keep the carrier 140 in engagement with the adjustment bolt 142.

An angle of 30 degrees permits the wrench to efficiently work in a very tight spot by the turning of the wrench over between each wrenching stroke.

The carrier 140 has two parallel spaced sidewalls 182 which are of flat stock and which are held in spaced parallel positions at the sides of a spacer 184 which has flat vertical sides.

The spacer 184 has a hump 186 extending upwardly into a position for engaging the underside of the forward end of a release 190 which is elongated forwardly and rearwardly.

The release 190 pivots on a horizontal axle 192 extending through the lever 70 sidewalls 193.

The axle 192 extends normally to the length of the lever 70 and its forward end can press down on the hump 186 to release the toggle action when the rearward end of the release 190 is raised up.

The spacer 184 is secured to the sidewalls 182 of the carrier 140 by a pair of rivets 198 disposed forwardly and rearwardly of each other.

Figure 1:
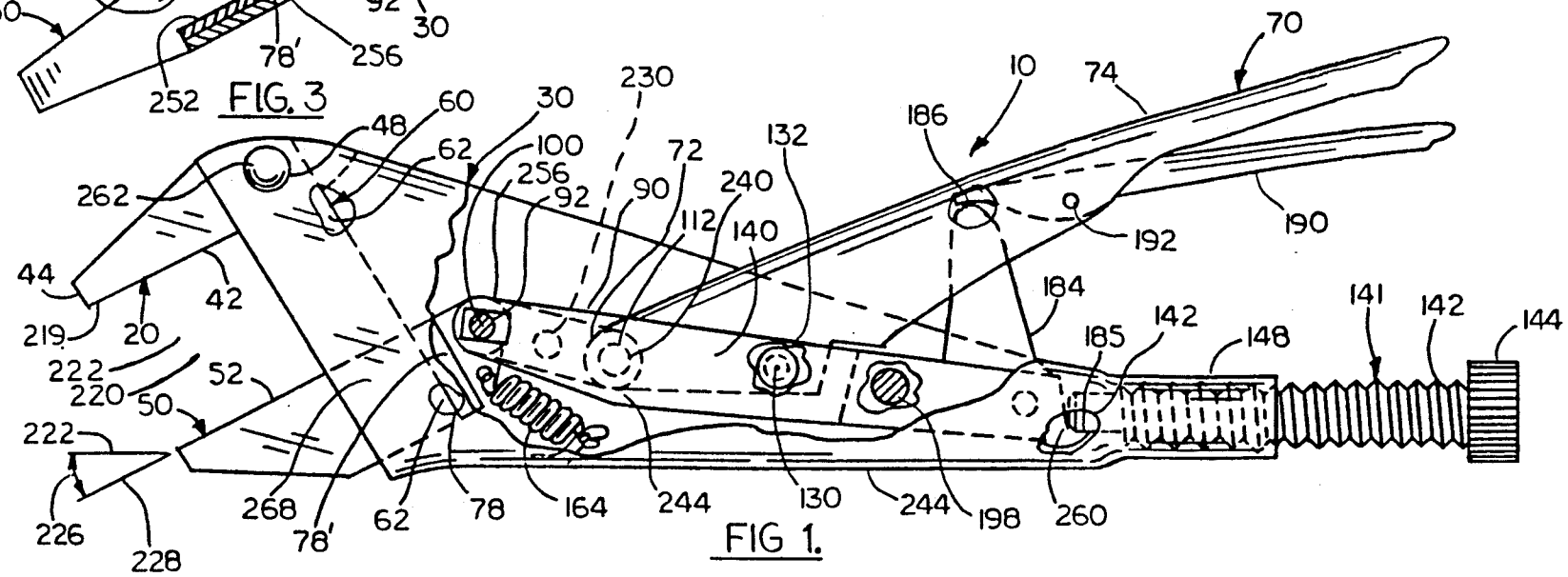
FIG. 1 is a side elevation of the wrench hereof with parts broken away of the handle, the carrier, a forward pin, a rivet and a lever. The parts are shown in pressure position, with the forward end of the handle in the high position.
Figure 4:
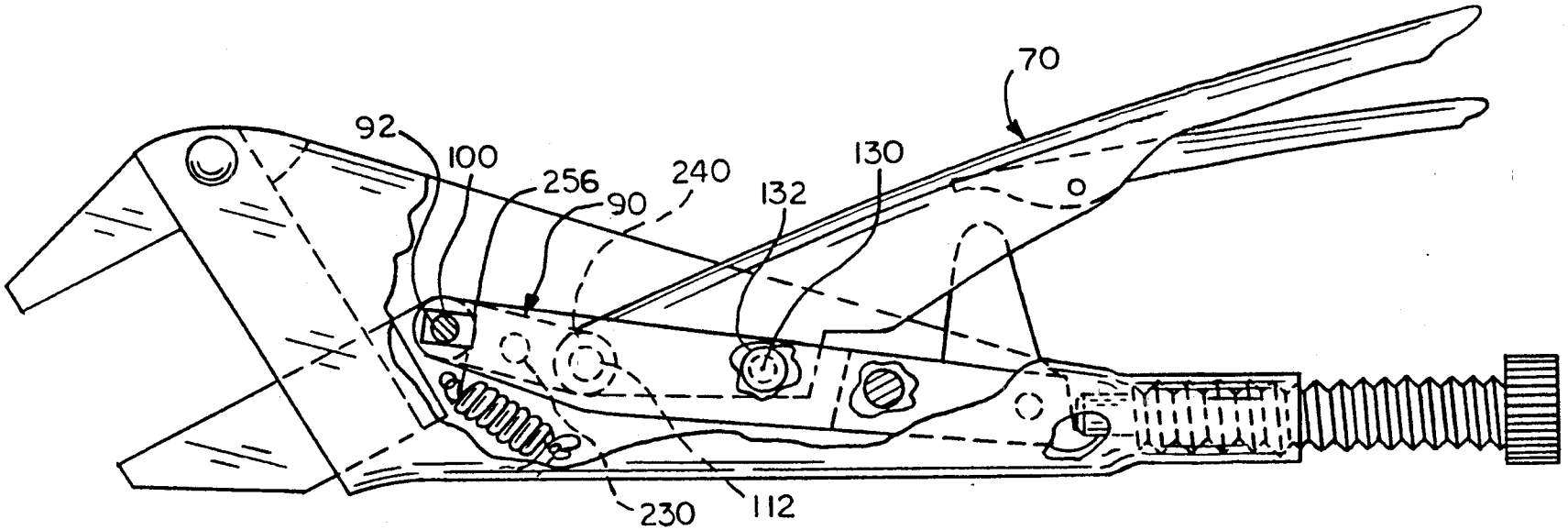
FIG. 4 is right side elevation with parts shown in non-clamping position and with certain parts broken away.
Figure 5:
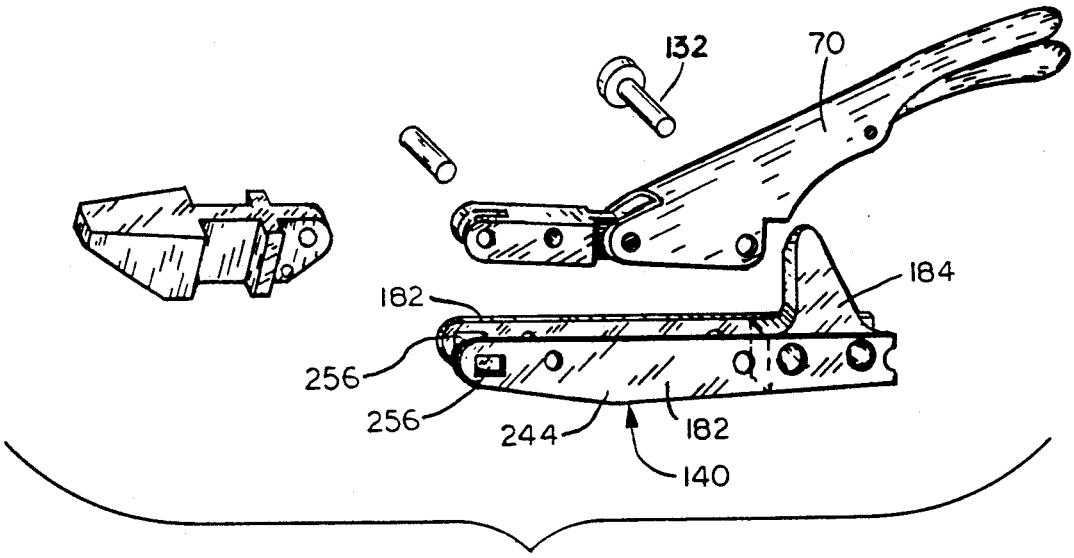
FIG. 5 is a perspective view of the interconnected assembly of the sliding jaw, link, lever and carrier.
Figure 6:
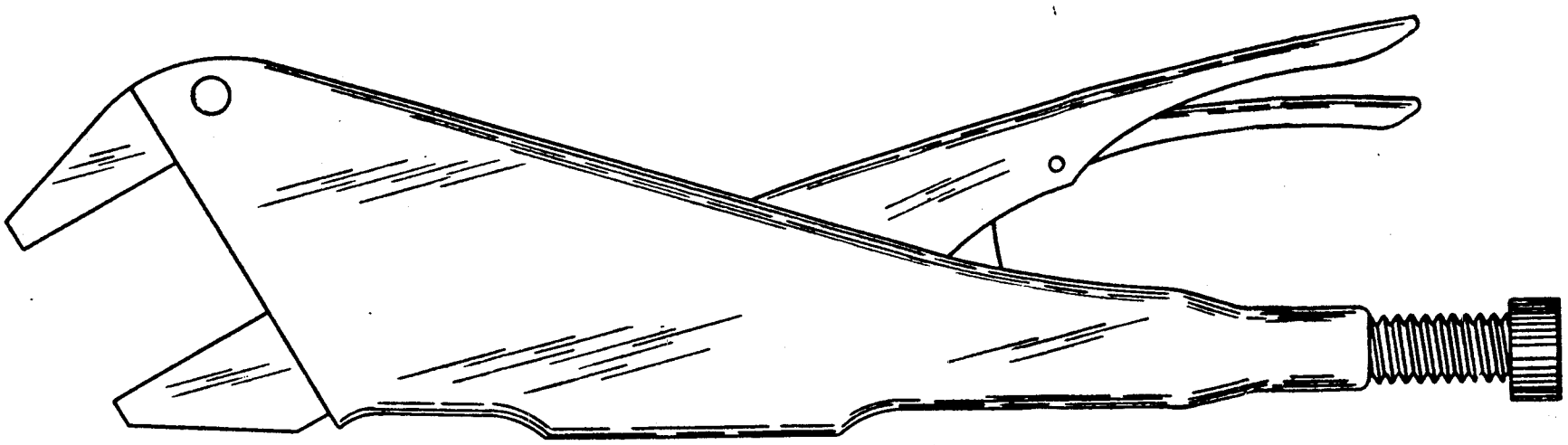
FIG. 6 is a side elevational view of an alternate embodiment of the invention.

The parallel pressure surfaces 42 and 52 of the jaws, when in the jaws-open position as shown in FIG. 1 with the handle 30 define a rectangular opening 219 having a center at 220.

In FIG. 1, the elongation of the handle 30, as represented by a straight line 222 along the substantially straight underside 224 of the handle 30 is at an angle 226 degrees of 30 degrees, with respect to the pressure surfaces of the jaws as represented by a line 228 for providing the advantages above described for working in tight places.

This 30 degree angle is efficient in tight places as earlier described.

The spacer 184 has a lower lip 185 which protrudes rearwardly under the forward end of the bolt 142.

A ball detente system 230 is operatively correlated between the carrier 140 and the link 90 to hold the moving parts in an overcomeable restraint when in the positioning shown of alignment of the axes 100, 112, and 130.

In FIG. 2, the detente system 230 has a ball disposed in a cavity 232 in a cavity 234 in the link 90 and urged by a spring 236 in the cavity 234 toward and into a recess 236' on the inner side of a carrier sidewall 182.

The pivot pins 92 at the axis 100 forward at the intermediate axis 112 must be pins, and not rivets, because there is no room for rivet heads if the forward head end of the wrench is compact and thin for tight places.

The pin 92 is held in place by the handle sidewalls 34 in all handle positions. But the pivot pin 240 will fall out when the lever 70 is moved to the down position at its forward end if the carrier sides are of uniform vertical dimension in side elevation.

So to solve this a special extra vertical height is provided on the carrier sidewalls 182 in the area of the forward pin 92 making extra carrier wall areas at 244.

Figure 3:
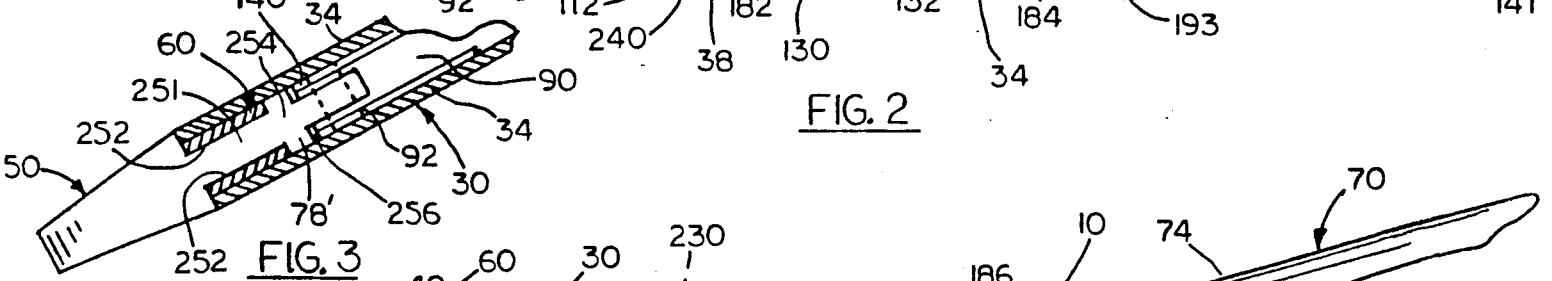
FIG. 3 is a sectional view along the forward part of line 3—3 of FIG. 1.

In FIG. 3, the moving jaw 50 has narrow portion 251 between and closely fitting the tracks 60 by means of left and right track-receiving jaw-notches 252 and has a wider rear portion 254 which engages the rearward edges of the tracks 60 for strength.

The carrier 140 has substantially similar right and left slots 256 in its sidewalls 182 respectively, the slots 256 receiving right and left ends of the pin 92 so that the forward end of the carrier 140 is held in position by pin 92.

The walls of the slots 256 closely fit the pin 92 as measured transversely to the handle elongation.

But the slots 256 extend rearwardly 3/32" beyond the pin 92 when the parts are in the clamping position of FIG. 1 so that the carrier 140 does not interfere with the upward pressure of link 90 on the sliding jaw 50.

The extent the carrier 140 must extend downwardly at 244 to provide support for the pin 100 to keep it from sliding out of place must be proportional to the lengths of the identical slots 256.

The wrench hereof is distinguished by being very rigid, very strong, and substantially without any bending, or "give" or, "springing". This is because it's special open-topped housing 30 of U-shape, forms what can be termed "THE IRON TRIANGLE" bounded by a first imaginary line not shown, between a first point 262 near the rearward end of the fixed jaw 20. Along this first line a stretching and bending force is applied resisted by iron along a second line from the adjustment bolt first point 260 forward to a third point 268 and the second point 262.

In FIG. 2, the fixed jaw 20 has a narrow section 272 between the tracks 60 and has a wider portion having right and left sections and disposed at the rear of the right and left tracks 60, respectively, and engaging them during wrenching for strength.

FIGS. 6 through 9 illustrate an alternate embodiment of the invention wherein like reference numerals are used to designate like parts of both embodiments.

Figure 7:
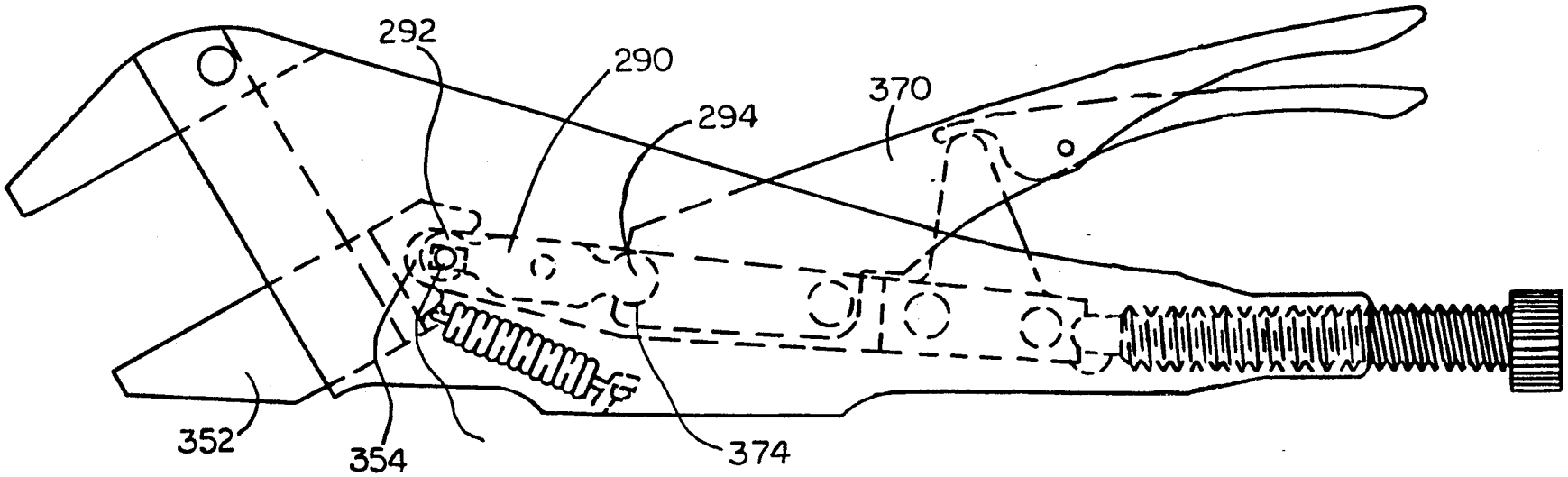
FIG. 7 is a side view of the wrench of FIG. 6 with hidden parts shown in dotted lines.

FIG. 7 shows a side view of the inner connected wrench assembly of the alternative embodiment with the hidden parts shown in dotted lines. As shown in the FIGURE, link 90 of FIGS. 1-5 has been replaced with link 290. Link 290 comprises rounded forward end 292 and rounded rearward end 294. Sliding jaw 52 of FIGS. 1-5 has been replaced with sliding jaw 352 having a rearward opening socket 354. Rearward opening socket 354 is adapted to slidable receive rounded forward end 292 of link 290. Lever 70 of FIGS. 1-5 has been replaced with lever 370 having forwardly facing sockets 372 (FIG. 9) and 374 formed in the forward end thereof and adapted to slidably receive the rearward rounded end 294 of link 290.

The improvement afforded by this embodiment is that the link 290 requires no pins for connection to the sliding jaw 352 and to the lever 370. Rather, the forward end 292 of link 290 is rounded for pivotal receipt with in a rearwardly opening socket 354 in sliding jaw 352. The ends of socket 354 extend overcenter with respect to a radial line through either of them, by 1/16th inch for example, so as to pivotally retain the forward end of the link 290 therein. Likewise, the rearward end 294 of link 290 is rounded for pivotal receipt within forwardly facing sockets 372 and 374 formed in the forward end of lever 370. This eliminates another pinned connection. More importantly, the interconnected assembly is made stronger and may be manufactured much less expensively than the embodiment of FIGS. 1-5 since the link, lever and carrier can all be punched out with a punch press. Furthermore, the pivot pin 392 may have the central portion thereof which goes through the hole the link knurled so that the tolerance need not be so exact.

Figure 8:
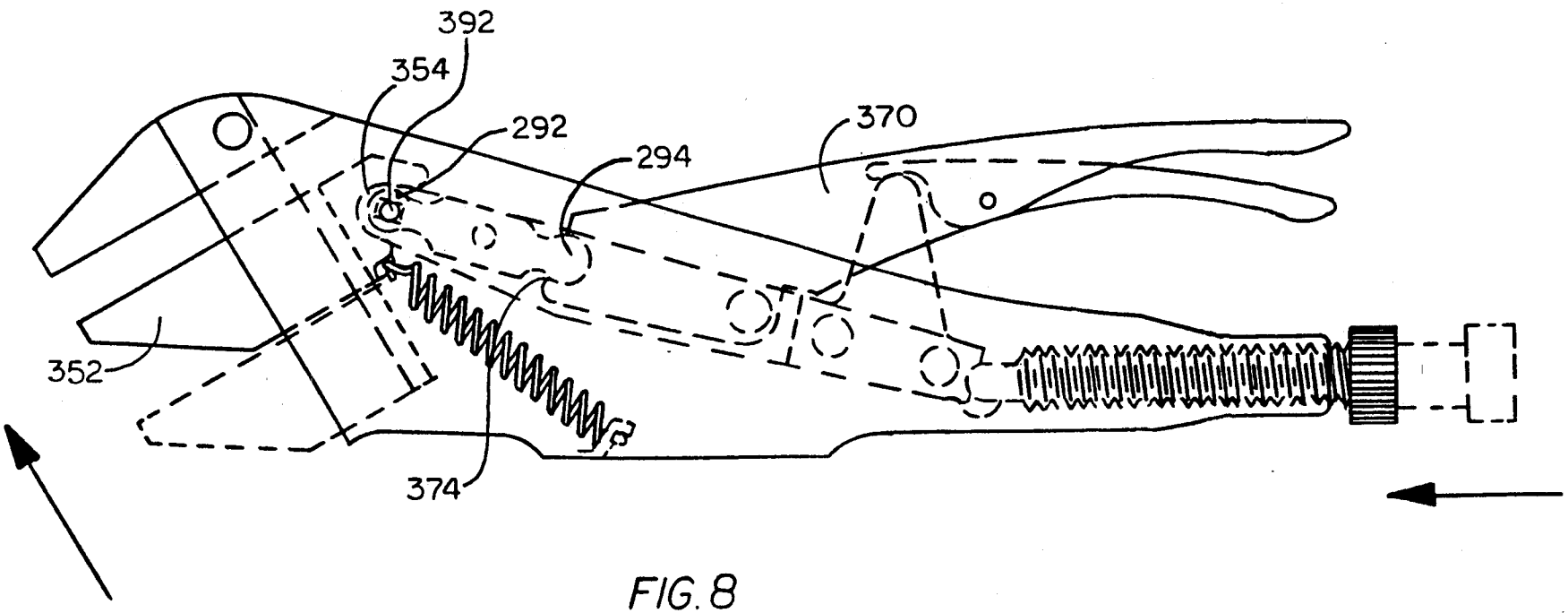
FIG. 8 is a side view of the wrench of FIG. 6 with the adjustment screw moved forwardly for partially closing the jaws.

FIG. 8 is a side view of the inner connected wrench assembly of the alternative embodiment also showing the hidden parts in dotted lines. Details shown in FIG. 8 are similar to those shown i in FIG. 7 with the exception that handle 370 has been moved to the closed position and the sliding jaw 352 has moved into the forward nut engagement position.

Figure 9:
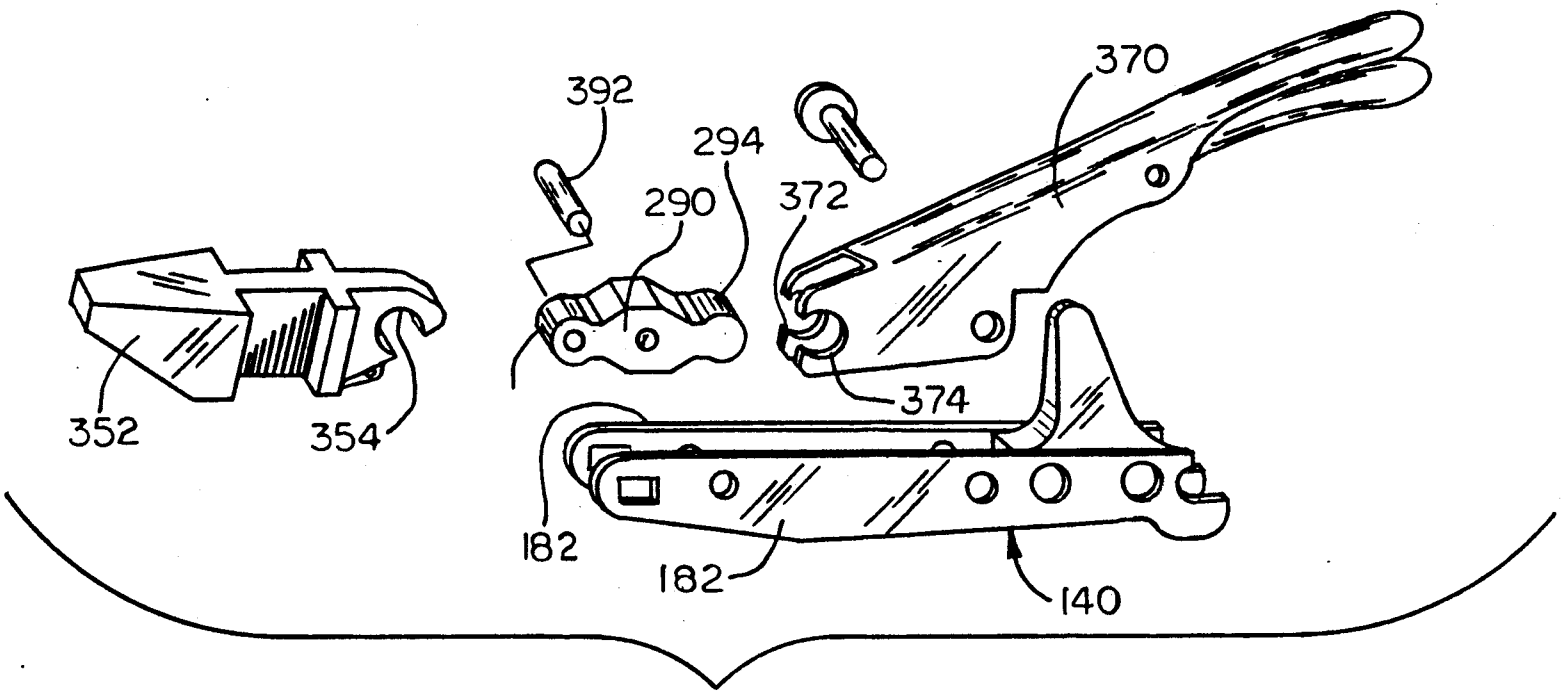
FIG. 9 is an exploded perspective view of the interconnected assembly of the wrench of FIG. 6.

FIG. 9 shows an exploded perspective view of the inner i connected wrench assembly of the alternative embodiment. FIG. 9 shows those components of the wrench modified in the alternative embodiment. As shown in the FIGURE, link 90 of FIGS. 1-5 has been replaced with link 290. Additionally, lever 70 has been replaced with lever 370 and sliding jaw 52 has been replaced with sliding jaw 352. As described above, sliding jaw 352 comprises a rearwardly opening socket 354 adapted to slidable receive the forward rounded end 292 of link 290. Lever 370 has been modified to comprise forwardly facing sockets 372 and 374 adapted to slidable receive rounded end 294 of link 290. As mentioned above this improvement eliminates the requirement of pins 92 and 132 shown in FIG. 5 to connect sliding jaw 352 and lever 370 to link 290.

It is obvious that numerous other modifications and variations of the present invention are possible in view of the above teachings. Therefore, it is to be understood that the above description is intended in no way to limit the scope of protection of the claims and is representative of only two of the several possible embodiments of the invention.

Thus, there has been shown and described an invention which accomplishes at least all of the stated objectives.

I claim:

1. A toggle wrench comprising:

a fixed jaw;

an elongated handle extending rearwardly from said fixed jaw and attached thereto, said handle having spaced right and left connected sidewalls;

said handle having a lower closed side and an opposite upper side adjacent said fixed jaw;

a sliding jaw below said fixed jaw, said jaws having forwardly extending pressure surfaces;

a track system mounted on said handle and having right and left tracks mounted on said right and left sidewalls respectively and elongated transversely of said pressure surfaces, said sliding jaw being guided by said tracks;

an elongated rearwardly extending hand lever having a forward portion movable between said sidewalls and a rearward portion protruding from said sidewalls on the upper side of said handle;

a link having a forward end pivotally attached to a rearward portion of said sliding jaw in a manner for the pivoting of said link about a forward axis, the forward end of said lever being pivotally secured to the rearward end of said link for rotation about an intermediate axis, said link being free of any direct pivotal connection to said handle;

a carrier elongated in parallelism with said handle and disposed between its said sidewalls;

means pivotally attaching said lever to said carrier for pivoting about a rearward axis rearwardly of said intermediate axis, said axes being parallel to each other and also being normal to the elongation of said handle;

coacting pin and slot connection means on said carrier and said forward end of the link whereby said forward end of the link is movable fore and aft relative to said carrier; and a threaded assembly mounted on the rearward end of said handle and having a manually rotatable adjustment portion movable fore and aft of said handle in response to threaded rotation thereof, said adjustment portion and carrier having coacting engagement surfaces such that forward threading movement of said adjustment portion forces said carrier to move forward toward said sliding jaw, said sliding jaw, link, lever, and carrier together defining an interconnected assembly, resilient means operably correlated with said interconnected assembly and said handle for urging said sliding jaw away from said fixed jaw, the forward end of said hand lever moving upwardly in response to downward pivotal movement of a rearward end of said lever about said rearward axis, thereby moving said intermediate axis toward a line between said forward and rearward axes and moving said forward end of said link forwardly relative to said carrier and thereby forcing said movable jaw toward said fixed jaw against the urging of said resilient means.

2. The wrench of claim 1 having said jaw pressure surfaces disposed at an angle of 30° with respect to the elongation of said handle.

3. The wrench of claim 1 wherein said carrier has sidewalls extending along opposite sides of said lever and of said link and serving to give support and to restrain said lever and said link from bending.

4. The wrench of claim 3 wherein said pin and slot connection means includes a slot in the forward end of each of said carrier sidewalls and, a pivot pin extending into said carrier sidewall slots for holding said carrier in position to give said support yet fitting said slots loosely enough that said lever can deliver pressure forward on said link greater than any effect of said carrier sidewalls on said link causing the forward end of said carrier to follow said sliding jaw.

5. The wrench of claim 4 wherein said carrier sidewall slots receive opposite ends of said pivot pin and extend generally transversely of said handle, said slots extending rearwardly beyond said pivot pin sufficiently that said carrier does not interfere with application of pressure by said link onto said lower jaw to urge it toward said fixed jaw.

6. The wrench of claim 5 further comprising an intermediate pin pivotally connecting the forward end of said lever to the rearward end of said link and said carrier sidewalls overlapping said forward pin and said intermediate pin so as to prevent them from sliding out of said link.

7. The wrench of claim 5 further comprising a carrier spacer between said carrier sidewalls and having a hump extending upwardly, a release pivoted on said lever and engaging said hump and capable of causing a release of jaw pressure by pressing on said hump.

8. The wrench of claim 3 having a spring-urged ball detente assembly exerting pressure to lock the forward end of said lever in a fixed down position with respect to said handle when said axes are in alignment, said ball detente assembly preventing said handle from flying outward when said wrench is used in a non-clamping manner as an adjustable wrench, said ball detente assembly comprising a ball disposed between said forward axis and said intermediate axis and mounted in said link, said carrier having a recess on an inner side of one of its said sidewalls and releasably receiving a part of said ball when said forward end of said lever is in said down position.

9. The wrench of claim 1 wherein said link comprises generally rounded forward and rearward portions and wherein said sliding law comprises a reward opening socket extending overcenter with respect to a line drawn therethrough and wherein said socket is adapted to slidably receive and pivotally retain said rounded forward portion of said link.

10. The wrench of claim 9 wherein said hand lever comprises forwardly opening sockets extending overcenter with respect to a line drawn therethrough and adapted to slidably receive and pivotally retain said reward rounded portion of said link.

* * * * *